US005813177A

United States Patent [19]

Wu

[11] Patent Number: 5,813,177

[45] Date of Patent: Sep. 29, 1998

[54] BUILT-UP PARTITION WALL FRAMEWORK SYSTEM

[76] Inventor: Chiang-Su Wu, No. 202, Jen-Ai 2nd Street, Kaohsiung, Taiwan

[21] Appl. No.: 946,376

[22] Filed: Oct. 7, 1997

[51] Int. Cl.[6] ..... E04B 2/32

[52] U.S. Cl. ..... 52/238.1; 52/241; 52/282.1; 52/481.2; 52/581; 52/800.11; 211/189

[58] Field of Search ..... 52/238.1, 239, 52/241, 242, 281.1, 281.2, 481.1, 481.2, 489.2, 581, 800.11, 800.12, 802.1; 211/189, 89, 182

[56] References Cited

U.S. PATENT DOCUMENTS

| | | | |
|---|---|---|---|
| 1,264,991 | 5/1918 | Stewart | 52/674 |
| 2,047,236 | 7/1936 | Thomas | 52/673 X |
| 3,511,000 | 5/1970 | Keuls | 52/731.9 X |
| 3,722,157 | 3/1973 | Prokop | 52/481.2 |
| 3,722,163 | 3/1973 | Satkin et al. | 52/241 X |
| 3,919,819 | 11/1975 | Oliver | 52/580 X |
| 5,125,201 | 6/1992 | Pieters et al. | 52/238.1 |
| 5,370,249 | 12/1994 | Harvey et al. | 211/189 |
| 5,377,466 | 1/1995 | Insalaco et al. | 52/238.1 |
| 5,528,876 | 6/1996 | Lu | 52/672 X |
| 5,529,192 | 6/1996 | Conen et al. | 52/672 X |

*Primary Examiner*—Minnie S. Yip
*Attorney, Agent, or Firm*—Varndell Legal Group

[57] ABSTRACT

A built-up partition wall framework system for building up partition wall frameworks in a building, including a plurality of main wall panels, a plurality of main wall panel coupling hook plates for connecting the main wall panels in parallel, a plurality of top channel rails for fastening to joined main wall panels at a top side, a plurality of bottom channel rails for fastening joined main wall panels at a bottom side, a plurality of channel-like latch pins for securing the top channel rails to the main wall panels, a plurality of wedge blocks for mounting between the bottom channel rails and the floor, a plurality of first side covers and second side covers for fastening to lateral sides of constructed partition wall frameworks, a plurality of mounting supports for securing constructed partition wall frameworks to vertical walls of the building, a plurality of T-wall external coupling hook plates, wall end coupling hook plates, internal angle coupling hook plate external angle coupling hook plates and wall to wall coupling hook plates for fastening constructed partition wall frameworks at different angles, and a plurality of filler plates filled in constructed partition wall frameworks.

1 Claim, 9 Drawing Sheets

BUILT-UP PARTITION WALL FRAMEWORK SYSTEM

BACKGROUND OF THE INVENTION

The present invention relates to building constructions, and more specifically to a build-up partition wall framework system for constructing partition walls in a building efficiently.

Conventionally, a solid partition wall of a building is built up with bricks or concrete. When building up a concrete partition wall, reinforcement bars are arranged in a formwork, and then concrete is poured in the formwork, and then the surface of the concrete partition wall is finished after concrete has been hardened. These brick and reinforced concrete partition wall constructing methods are complicated.

SUMMARY OF THE INVENTION

It is one object of the present invention to provide a built-up partition wall framework system for building up partition walls which can be conveniently set up at the job site. It is another object of the present invention to provide a built-up partition wall framework system for building up partition walls which greatly saves partition wall constructing time. It is still another object of the present invention to provide a built-up partition wall framework system for building up partition walls which makes the surface finishing easy. It is still another object of the present invention to provide a built-up partition wall framework system for building up partition walls which can be conveniently set up at the job side without the use of screws. According to the invention, the built-up partition wall framework system comprises a plurality of main wall panels, a plurality of main wall panel coupling hook plates for connecting the main wall panels in parallel, a plurality of top channel rails for fastening to joined main wall panels at a top side, a plurality of bottom channel rails for fastening joined main wall panels at a bottom side, a plurality of channel-like latch pins for securing the top channel rails to the main wall panels, a plurality of wedge blocks for mounting between the bottom channel rails and the floor, a plurality of first side covers and second side covers for fastening to lateral sides of constructed partition wall frameworks, a plurality of mounting supports for securing constructed partition wall frameworks to vertical walls of the building, a plurality of T-wall external coupling hook plates, wall end coupling hook plates, internal angle coupling hook plate external angle coupling hook plates and wall to wall coupling hook plates for fastening constructed partition wall frameworks at different angles, and a plurality of filler plates filled in constructed partition wall frameworks.

DETAILED DESCRIPTION OF THE PREFERRED EMBODIMENT

Figure 1:
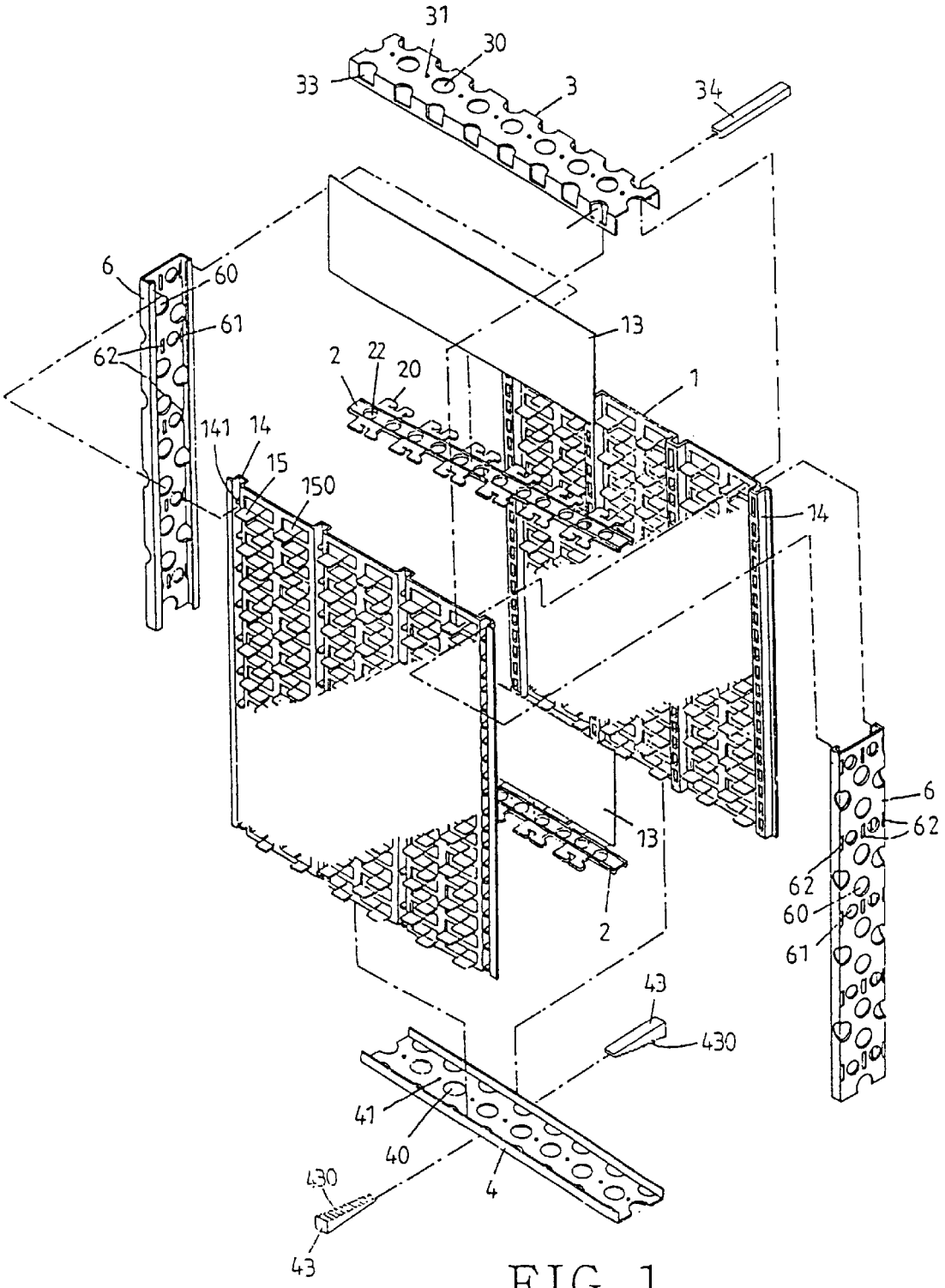
FIG. 1 is an exploded view of a partition wall framework base unit for constructing a built-up partition wall framework system according to the present invention.

Referring to Figures from 1 to 13, a built-up partition wall framework system in accordance with the present invention comprises a plurality of main wall panels 1, a plurality of main wall panel coupling hook plates 2, a plurality of top channel rails 3, a plurality of bottom channel rails 4, a plurality of channel-like latch pins 34, a plurality of wedge blocks 43, a plurality of first side covers 5, a plurality of second side covers 6, a plurality of mounting supports 7, a plurality of T-wall external coupling hook plates 8, a plurality of wall end coupling hook plates 9, a plurality of internal angle coupling hook plate 10, a plurality of external angle coupling hook plates 11, a plurality of wall to wall coupling hook plates 12, and a plurality of filler plates 13. When a partition wall framework system is set up, cement paste is sprayed over the partition wall framework system, and thus a cement partition wall is set up after the cement paste has hardened and its surface has been finished.

Figure 2A:
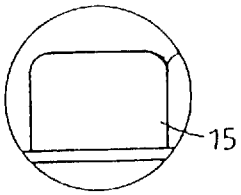
FIG. 2A is an enlarged view of a part of FIG. 2.
Figure 2:
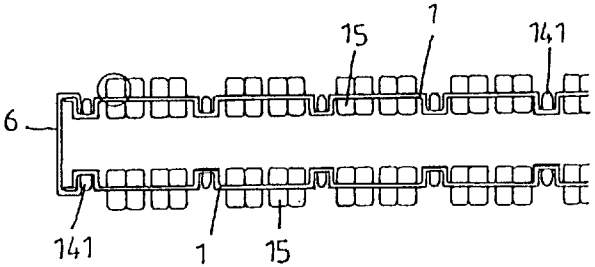
FIG. 2 is a top view of a partition wall framework base unit according to the present invention.

Each main wall panel 1 comprises a plurality of longitudinal channel ribs 14 arranged in parallel, rows of longitudinally and equally spaced projecting strips 141 respectively raised in the longitudinal channel ribs 14, the projecting strips 141 having a respective smoothly curved safety end, parallel rows of longitudinally spaced coupling holes 150, and reinforcing flanges 15 perpendicularly raised from the coupling holes 150 in reversed directions, the reinforcing flanges 15 having a respective smoothly curved safety end (see FIGS. 1 and 2).

Figure 3:
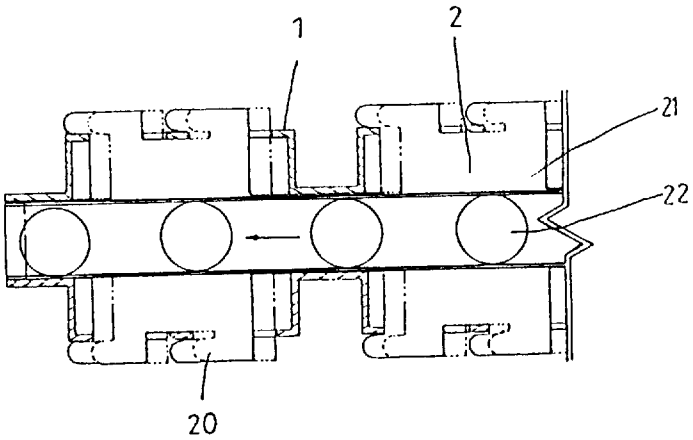
FIG. 3 is a top view of a part of the present invention, showing a main wall panel coupling hook plate connected between two main wall panels.

The main wall panel coupling hook plates 2 are elongated hook plates. Each main wall panel coupling hook plate 2 comprises a plurality of longitudinally spaced circular holes 22, two parallel reinforcing ribs 21 longitudinally disposed at two opposite sides of the circular holes 22, and a plurality of hook strips 20 symmetrically raised from the reinforcing ribs 21 in reversed directions, the hooked strips 20 having a respective smoothly curved front end. Two main wall panels 1 can be connected in parallel by two main wall panel coupling hook plates 2 by hooking the respective hooked strips 20 into the respective coupling holes 150 (see FIGS. 1 and 3).

Figure 4:
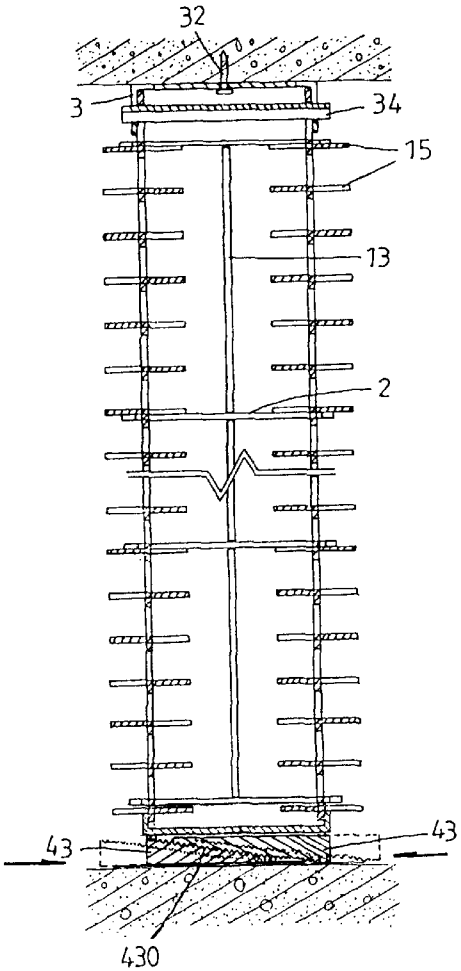
FIG. 4 is a side view of a build-up partition wall framework constructed according to the present invention, showing the installation of the wedge blocks.
Figure 5:
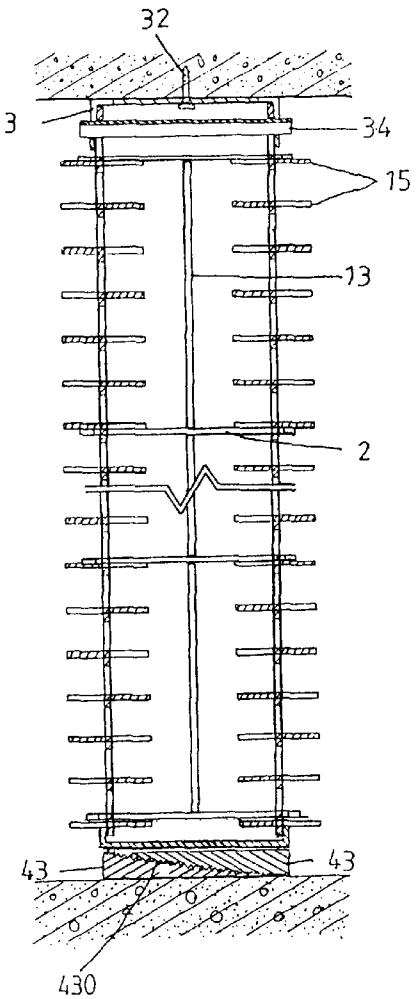
FIG. 5 is similar to FIG. 4 but showing the wedge blocks installed.
Figure 6:
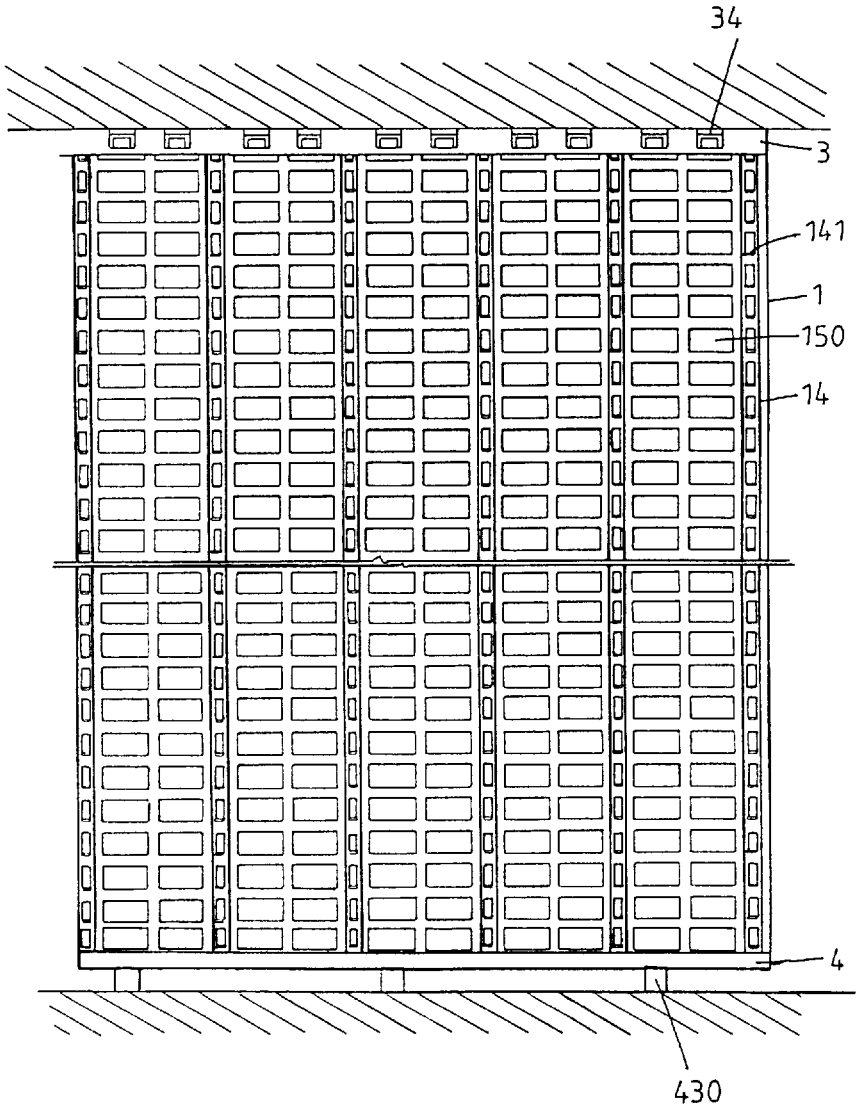
FIG. 6 is a front plain view of a build-up partition wall framework constructed according to the present invention.

The top channel rails 3 are adapted for fastening to joined main wall panels 1 at the top. Each top channel rail 34 comprises a plurality of longitudinally spaced circular wire holes 30 corresponding to the circular holes 22 of the main wall panel coupling hook plates 2 for inserting electrical wires, a plurality of small mounting holes 31 alternatively spaced by the circular wire holes 30 for fastening to a ceiling wall by steel nails 32 (see FIGS. 4 and 5), and a plurality of rectangular side holes 33 symmetrically disposed at two opposite lateral sides and equally spaced along the length.

The bottom channel rails 4 are adapted for fastening to joined main wall panels 1 at the bottom. Each bottom channel rail 4 comprises a plurality of longitudinally spaced circular wire holes 40 corresponding to the circular holes 22 of the main wall panel coupling hook plates 2 for inserting electrical wires, and a plurality of small mounting holes 41 alternatively spaced by the circular wire holes 40 for fastening to a floor wall by steel nails (see FIGS. 4 and 5).

The channel-like latch pins 34 are adapted for fastening to the rectangular side holes 33 of the top channel rails 3 and the coupling holes 150 of the main wall panels 1 to fix the top channel rails 3 and the main wall panels 1 together.

The wedge blocks 43 are shaped like a right-angled triangle, having transverse teeth 430 on the respective hypotenuse. By engaging the respective transverse teeth 430 of one wedge block 43 with another, the wedge blocks 43 are matched in pair, and each pair of matched wedge blocks 43 are sandwiched in between one bottom channel rail 4 and the floor wall (see FIGS. 4 and 5).

Figure 7:
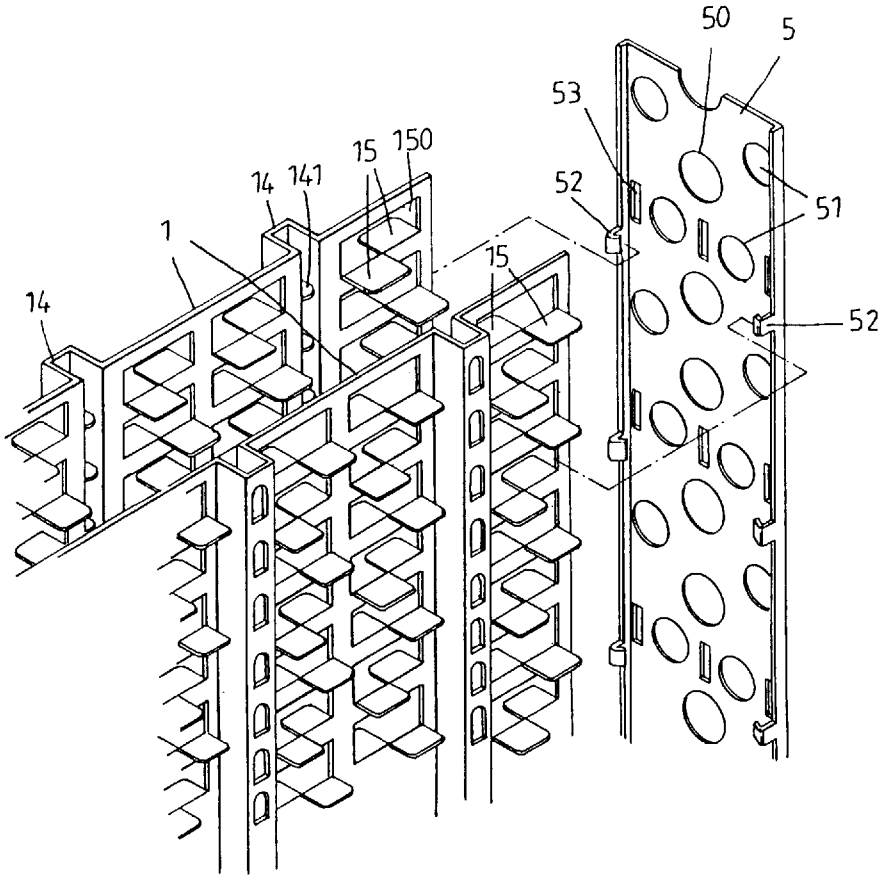
FIG. 7 shows the relationship between a first side cover and two joined main wall panels according to the present invention.

The first side covers 5 are adapted for fastening to two joined main wall panels 1, that are laterally cut and have the respective laterally disposed longitudinal reinforcing ribs 14 removed, at one lateral side. Each first side cover 5 comprises a plurality of big circular holes 50 and small circular holes 51 for inserting electrical wires, a plurality of hooks 52 symmetrically raised from two opposite lateral sides and adapted for fastening to the corresponding coupling holes 150 of each two joined and cut main wall panels 1 (see FIG. 7), and three longitudinal rows of equally spaced rectangular holes 53 for mounting the T-wall external coupling hook plates 8, the wall end coupling hook plates 9, the internal angle coupling hook plate 10, the external angle coupling hook plates 11, or the wall to wall coupling hook plates 12.

The second side covers 6 are shaped like a channel bar and adapted for fastening to the longitudinal reinforcing ribs 14 of each two joined main wall panels 1 at lateral sides. Each second side cover 6 comprises a plurality of big circular holes 60 and small circular holes 61 for inserting electrical wires, and three longitudinal rows of equally spaced rectangular holes 62 for mounting the T-wall external coupling hook plates 8, the wall end coupling hook plates 9, the internal angle coupling hook plate 10, the external angle coupling hook plates 11, or the wall to wall coupling hook plates 12.

Figure 8:
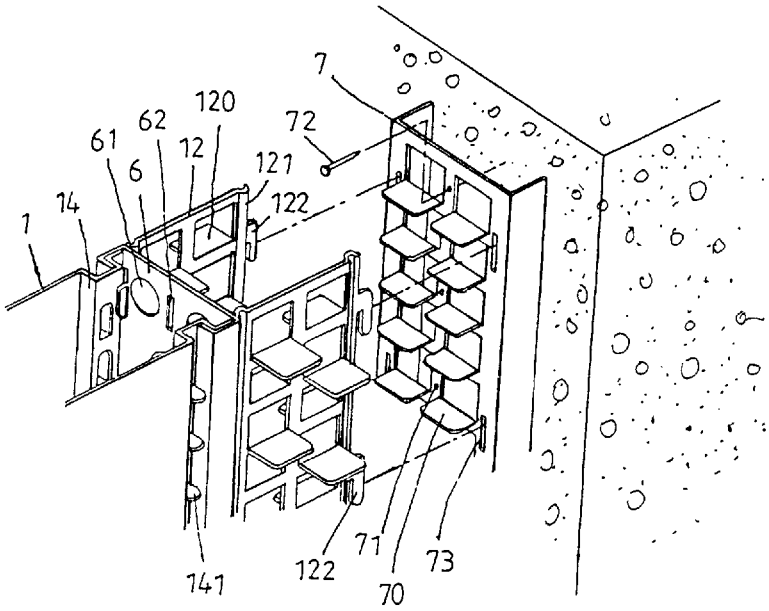
FIG. 8 shows the relationship between one mounting support and a second side cover at one end of a build-up partition wall framework according to the present invention.

The mounting supports 7 are shaped like a channel bar and adapted for securing the second side covers 6 to a vertical wall. Each mounting support 7 comprises longitudinal rows of equally spaced projecting strips 70 for binding cement, the projecting strips 70 having a respective smoothly curved safety end, a plurality of longitudinally spaced small holes 71 in the middle respectively fastened to one vertical wall of the building by steel nails 72, two longitudinal rows of rectangular holes 73 at two opposite sides of the projecting strips 70 respectively connected to the corresponding rectangular holes 62 of the corresponding second side covers 6 by the wall to wall coupling hook plates 12 (see FIG. 8).

Figure 9:
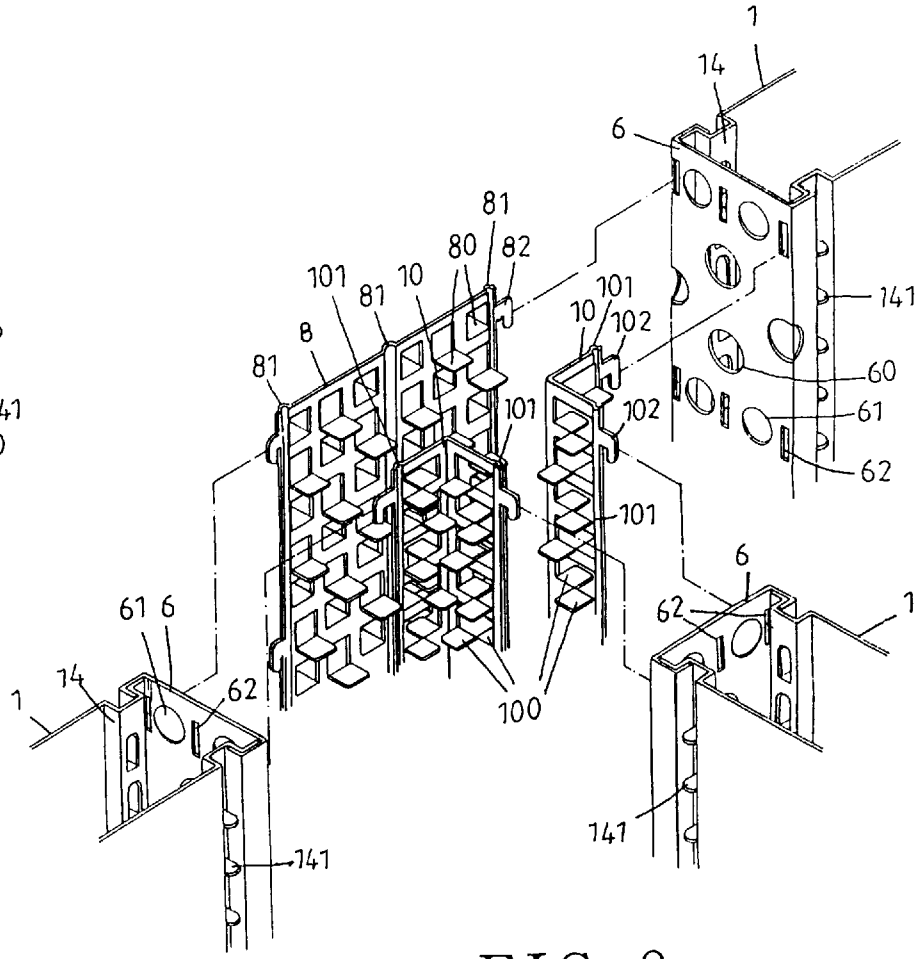
FIG. 9 is an exploded view of a T-shaped built-up partition wall framework according to the present invention.

The T-wall external coupling hook plates 8 are flat coupling plates adapted for connecting two second side covers 6 together. Each T-wall external coupling hook plate 8 comprises reversed pairs of projecting strips 80 for binding cement, the projecting strips 80 having a respective smoothly curved safety end, a plurality of longitudinally extended reinforcing ribs 81, and a plurality of hooks 82 raised from two opposite lateral sides and adapted for fastening to the rectangular holes 62 of the second side covers 6 (see FIG. 9).

Figure 10:
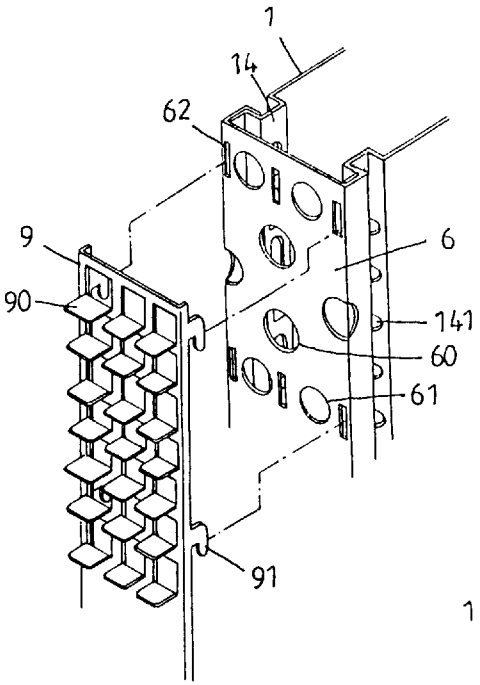
FIG. 10 shows the relationship between one wall end coupling hook plate and a second side cover at one end of a build-up partition wall framework according to the present invention.

The wall end coupling hook plates 9 are shaped like a channel bar, and adapted for fastening to the second side covers 6 at one end of a built-up partition wall framework constructed according to the present invention. Each wall end coupling hook plate 9 comprises a plurality of projecting strips 90 for binding cement, the projecting strips 90 having a respective smoothly curved safety end, and a plurality of hooks 91 raised from two opposite lateral sides and adapted for fastening to the rectangular holes 62 of the second side covers 6 and the rectangular holes 53 of the first side covers 5 (see FIG. 10).

Figure 11:
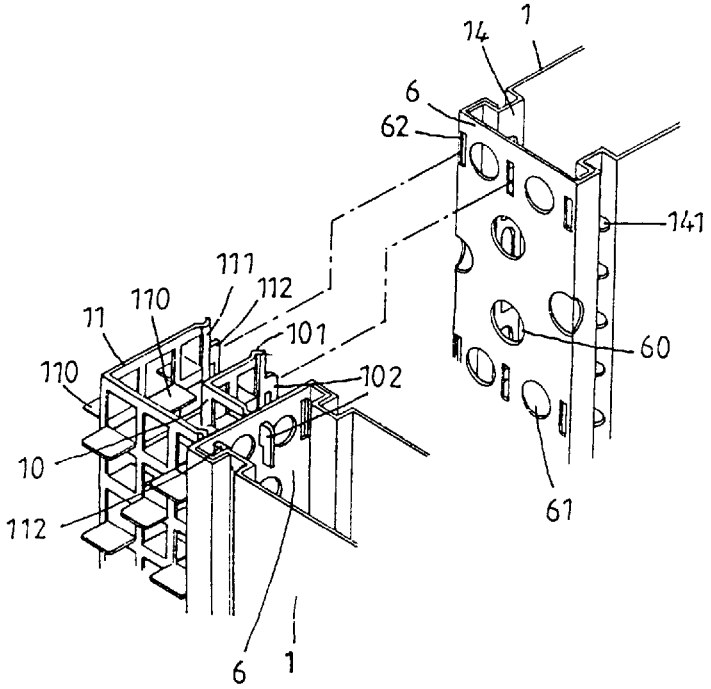
FIG. 11 is an exploded view of a L-shaped built-up partition wall framework according to the present invention.

The internal angle coupling hook plates 10 are angled coupling hook plates adapted for fastening two built-up partition wall frameworks at right angles or perpendicularly. Each internal angle coupling hook plate 10 comprises reversed pairs of projecting strips 100 for binding cement, the projecting strips 100 having a respective smoothly curved end, two longitudinal reinforcing ribs 101 at two opposite lateral sides, and a plurality of hooks 102 raised from two opposite lateral sides and adapted for fastening to the rectangular holes 62 of the second side covers 6 (see FIGS. 9 and 11).

The external angle coupling hook plates 11 are angled coupling hook plates adapted for fastening two built-up partition wall frameworks at right angles. Each external angle coupling hook plate 11 comprises reversed pairs of projecting strips 110 for binding cement, the projecting strips 110 having a respective smoothly curved end, two longitudinal reinforcing ribs 111 at two opposite lateral sides, and a plurality of hooks 112 raised from two opposite lateral sides and adapted for fastening to the rectangular holes 62 of the second side covers 6 (see FIG. 11).

Figure 13:
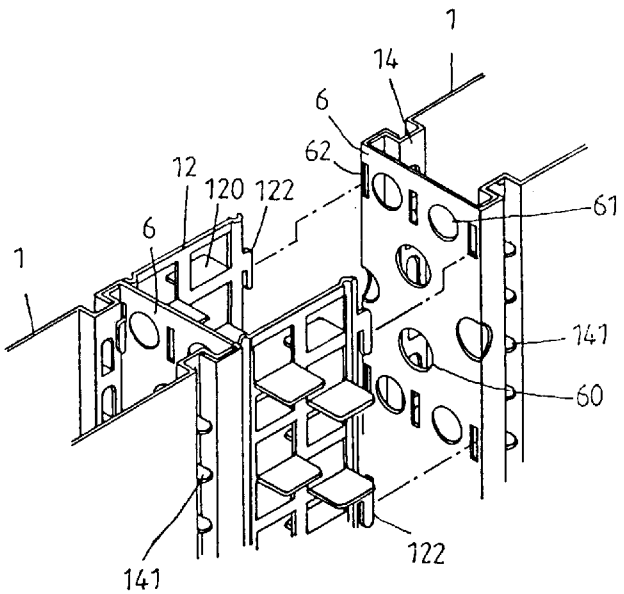
FIG. 13 shows the installation of wall to wall coupling hook plates between two built-up partition wall frameworks according to the present invention (II).
Figure 12:
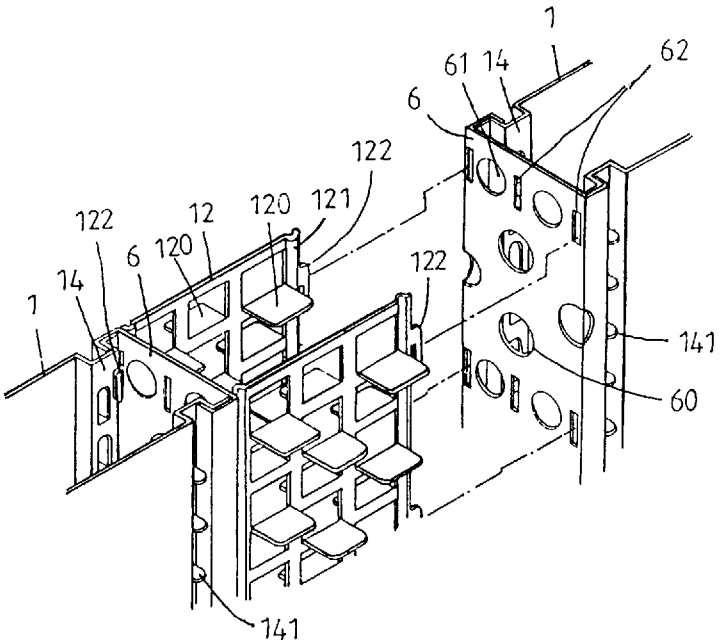
FIG. 12 shows the installation of wall to wall coupling hook plates between two built-up partition wall frameworks according to the present invention (I)

The wall to wall coupling hook plates 12 are flat hook plates made of different widths and arranged in pair for fastening two built-up partition wall frameworks in a line. Each wall to wall coupling hook plate 12 comprises reversed pairs of projecting strips 120 for binding cement, the projecting strips 120 having a respective smoothly curved safety end, two longitudinal reinforcing ribs 121 at two opposite lateral sides, and a plurality of hooks 122 raised from two opposite lateral sides and adapted for fastening to the rectangular holes 62 of the second side covers 6 (see FIGS. 12 and 13).

The filler plates 13 are mounted in between the main wall panels 1 of constructed built-up partition wall frameworks and supported in vertical between each two main wall panel coupling hook plates 2 (see FIG. 1). The filler plates 13 can be made in a solid structure, or a hollow structure filled up with foamed materials, meshed sheets, etc.

It is to be understood that the drawings are designed for purposes of illustration only, and are not intended as a definition of the limits and scope of the invention disclosed.

I claim:

1. A built-up partition wall framework system for building up partition wall frameworks in a building, comprised of a plurality of main wall panels, a plurality of main wall panel coupling hook plates, a plurality of top channel rails, a plurality of bottom channel rails, a plurality of channel-like latch pins, a plurality of wedge blocks, a plurality of first side covers, a plurality of second side covers, a plurality of mounting supports, a plurality of T-wall external coupling hook plates, a plurality of wall end coupling hook plates, a plurality of internal angle coupling hook plate, a plurality of external angle coupling hook plates, a plurality of wall to wall coupling hook plates, and a plurality of filler plates, wherein:

each of said main wall panels comprises a plurality of longitudinal channel ribs arranged in parallel, rows of longitudinally and equally spaced projecting strips respectively raised in the longitudinal channel ribs, the projecting strips of said main wall panels having a respective smoothly curved safety end, parallel rows of longitudinally spaced coupling holes formed between said projecting strips, and reinforcing flanges perpendicularly raised from said coupling holes in reversed directions, said reinforcing flanges having a respective smoothly curved safety end;

said main wall panel coupling hook plates are elongated hook plates, each of said main wall panel coupling hook plates comprising a plurality of longitudinally spaced circular holes, two parallel reinforcing ribs longitudinally disposed at two opposite sides of said elongated hook plate, and a plurality of hook strips symmetrically extending outwardly from said two opposite sides in reversed directions and adapted for hooking in the coupling holes of said main wall panels for joining a pair of said main wall panels together, said hooked strips having a respective smoothly curved front end;

said top channel rails are adapted for fastening to joined said main wall panels at a top side, each of said top channel rail comprising a plurality of longitudinally spaced circular wire holes corresponding to the circular holes of said main wall panel coupling hook plates for inserting electrical wires, a plurality of small mounting holes for fastening said top channel rail to a ceiling wall by steel nails, and a plurality of rectangular side holes symmetrically disposed at two opposite lateral sides of said top channel rail;

said bottom channel rails are adapted for fastening to joined said main wall panels at a bottom side, each of said bottom channel rails comprising a plurality of longitudinally spaced circular wire holes corresponding to the circular holes of said main wall panel coupling hook plates for inserting electrical wires, and a plurality of small mounting holes alternatively spaced by the circular wire holes for fastening said bottom channel rail to a floor wall by steel nails;

said channel-like latch pins are adapted for fastening to the rectangular side holes of said top channel rails and the coupling holes of said main wall panels for fixing said top channel rails and said main wall panels together;

said wedge blocks are shaped like a right-angled triangle, having transverse teeth on the respective hypotenuse, said wedge blocks being matched in pair by engaging the respective transverse teeth of one wedge block with another, each pair of matched wedge blocks for being sandwiched in between one bottom channel rail and the floor wall;

said first side covers are adapted for fastening to two joined said main wall panels, wherein said main wall panels are laterally cut and have the respective laterally disposed longitudinal reinforcing ribs removed at lateral sides, each of said first side covers comprising a plurality of big circular holes and small circular holes for inserting electrical wires, a plurality of hooks symmetrically and perpendicularly raised from two opposite lateral sides and adapted for engaging and fastening to the corresponding coupling holes of each two joined and cut said main wall panels at said lateral sides, and three longitudinal rows of equally spaced rectangular holes formed between said big and small circular holes;

said second side covers are shaped like a channel bar having two longitudinal flanges and adapted for engaging and fastening to the longitudinal reinforcing ribs of each two joined said main wall panels at lateral sides, each of said second side covers comprising a plurality of big circular holes and small circular holes for inserting electrical wires, and three longitudinal rows of equally spaced rectangular holes disposed between said big and small circular holes;

said mounting supports are shaped like a channel bar and adapted for securing said second side covers to a vertical wall, each of said mounting supports comprising longitudinal rows of equally spaced projecting strips for binding cement to the framework, the projecting strips of said mounting supports having a respective smoothly curved safety end, a plurality of longitudinally spaced small holes in the middle of said channel bar adapted for fastening to a vertical wall of the building by steel nails, two longitudinal rows of rectangular holes at two opposite sides of said channel bar adapted for connecting to the rectangular holes of said second side covers by said wall to wall coupling hook plates;

said T-wall external coupling hook plates are flat coupling plates adapted for connecting two second side covers together, each of said T-wall external coupling hook plates comprising reversed pairs of projecting strips for binding cement to the framework, the projecting strips of said T-wall external coupling hook plates having a respective smoothly curved safety end, a plurality of longitudinally extended reinforcing ribs, and a plurality of hooks raised extending outwardly from two opposite lateral sides of said T-wall external coupling hook plates and adapted for fastening to the rectangular holes of said second side covers;

said wall end coupling hook plates are shaped like a channel bar and adapted for fastening to said second side covers, each of said wall end coupling hook plates comprising a plurality of projecting strips for binding cement, the projecting strips of said wall end coupling hook plates having a respective smoothly curved safety end, and a plurality of hooks perpendicularly raised from two opposite lateral sides and adapted for fastening to the rectangular holes of said second side covers and the rectangular holes of said first side covers respectively;

said internal angle coupling hook plates are angled coupling hook plates adapted for fastening two built-up partition wall frameworks at right angles or perpendicularly, each of said internal angle coupling hook plates comprising two elongated plates formed angularly with each other, said elongated plates having reversed pairs of projecting strips for binding cement to the framework, the projecting strips of said internal angle coupling hook plates having a respective smoothly curved end, two longitudinal reinforcing ribs at two opposite lateral sides of said elongated plates, and a plurality of hooks extending outwardly from two opposite lateral sides and adapted for engaging and fastening to said rectangular holes of said second side covers;

said external angle coupling hook plates are angled coupling hook plates adapted for fastening two built-up partition wall frameworks at right angles, each of said external angle coupling hook plates comprising two elongated plates formed angularly with each other, said elongated plates having reversed pairs of projecting strips for binding cement to the framework, the projecting strips of said external angle coupling hook plates having a respective smoothly curved end, two longitudinal reinforcing ribs at two opposite lateral sides of said elongated plates, and a plurality of hooks extending outwardly from two opposite lateral sides and adapted for engaging and fastening to said rectangular holes of the second side covers and being positioned externally of said internal angle coupling hook plate;

said wall to wall coupling hook plates are flat hook plates made of different widths and arranged in pair for fastening two built-up partition wall frameworks in a line, each of said wall to wall coupling hook plates comprising reversed pairs of projecting strips for binding cement, the projecting strips of said wall to wall coupling hook plates having a respective smoothly curved safety end, two longitudinal reinforcing ribs at two opposite lateral sides, and a plurality of hooks extending outwardly from two opposite lateral sides and adapted for fastening to the rectangular holes of said second side covers;

said filler plates are adapted to be mounted in parallel between said main wall panels and supported in vertical between each two main wall panel coupling hook plates.

* * * * *